United States Patent [19]

Ealy

[11] 4,255,883

[45] Mar. 17, 1981

[54] ATTITUDE CONTROL SYSTEM

[75] Inventor: David A. Ealy, Greene, Iowa

[73] Assignee: ComTec Corporation, Greene, Iowa

[21] Appl. No.: 895,012

[22] Filed: Apr. 10, 1978

[51] Int. Cl.[3] ..... E02F 5/06

[52] U.S. Cl. ..... 37/83; 37/DIG. 20; 172/4.5

[58] Field of Search ..... 37/83, 86, DIG. 1, DIG. 14, 37/108 R, DIG. 20; 172/4.5; 404/84

[56] References Cited

U.S. PATENT DOCUMENTS

| | | | |
|---|---|---|---|
| 2,916,836 | 12/1959 | Stewart et al. | 37/DIG. 1 |
| 3,026,638 | 3/1962 | Hayner et al. | 37/DIG. 1 |
| 3,044,194 | 7/1962 | Balkheimer | 37/DIG. 1 |
| 3,046,681 | 7/1962 | Kutzler | 37/DIG. 1 |
| 3,266,179 | 8/1966 | Golden | 37/86 |
| 4,041,623 | 8/1977 | Miller et al. | 37/DIG. 1 |
| 4,050,171 | 9/1977 | Teach | 37/86 |
| 4,149,251 | 10/1979 | Noordermeer | 37/DIG. 1 X |

*Primary Examiner*—E. H. Eickholt

*Attorney, Agent, or Firm*—Breneman, Kane & Georges

[57] ABSTRACT

An attitude control system for controlling a pitch angle in relation to a horizontal pitch reference in systems wherein the components of pitch angle and horizontal pitch combine to determine a parallel path of travel with respect to a horizontal reference plane. The attitude control system consists of a slope sensor for measuring and compensating for pitch attitude changes in conjunction with a grade control system for monitoring horizontal reference. The present attitude control system is applicable to trenching machines whereby soil conditions affecting pitch angle are compensated in conjunction with horizontal pitch to control a predetermined grade or the pitch angle can be utilized alone to control slope of an excavation line.

32 Claims, 5 Drawing Figures

10
11
12
13
14
15
16
17
18
20
21

ATTITUDE CONTROL SYSTEM

BACKGROUND OF THE INVENTION

1. Field of the Invention

The invention pertains to an attitude control system wherein a pitch angle and horizontal pitch combine to determine a parallel path of travel of a connected member with respect to a horizontal reference plane. More particularly the invention relates to an attitude control system for earth moving machines and, specifically to the control of the attitude of the digging implement.

2. Description of the Prior Art

Various control systems for determining the attitude of the path of travel of an object are the subject matter of a number of prior art references. The present control system pertains not only to a means for controlling the path of travel of an object with respect to a horizontal reference but also means for controlling a horizontal pitch angle, the combination of which determines the path of travel of a connected member with respect to a horizontal reference.

Control systems wherein a path of travel of a connected member are monitored or controlled by pitch angle and horizontal pitch have generally been controlled by horizontal pitch control alone. However in many applications it is necessary to monitor, process and control both pitch angle and horizontal pitch in order to achieve the advantages of an improved system. It will be recognized that such control systems are applicable to aircraft, vehicles and heavy earth moving machinery.

Earth moving machinery such as automated trenching machines have found particular usefulness in digging drainage ditches. In addition to the digging function, typical trenching machines may also lay drainage tile or pipe in the bottom of the ditch to facilitate drainage. Various forms of earth moving and digging implements are used which can be controlled by the present invention. One form of digging implement may consist of an endless chain carrying a plurality of digging scoops or shovels and supported by a boot. Despite the particular type of trencher such as, plow, or chain the digging implement is hinged to the trencher and terminates in a support boot that rests on the bottom of the ditch which is being excavated.

A laser system or other means is generally employed as a horizontal pitch reference for a reference plane to establish the desired attitude for a ditch. The current state of the art employs a laser beam as a horizontal reference in which the laser control system senses that the digging arm is cutting a ditch deeper than that established by the reference plane, it increases the up attitude of the bottom of the boot supporting the digging. An increasing up attitude of the boot of the digging arm tends to allow the digging arm to plane up out of the ditch. In normal operation the digging arm will not ride up completely out of the ditch but will level off at a depth depending upon the final attitude established by the laser reference of the boot supporting the digging arm. Likewise, if the laser sensing system determines that the depth of the ditch being dug is too shallow as determined by the reference plane, it will decrease this up pitch tending to cause the digging arm to dig itself deeper into the ditch.

Operators of such trenchers have experienced problems maintaining a uniform ditch attitude when the consistency of the soil being excavated changes. For example, if the digging arm of a trencher which had previously been digging dirt reaches a sandy portion of the earth, the boot finds less support than it did when the digging implement was digging dirt. As a result, a digging arm drops down and the laser referenced grade control then increases the planing angle of the bottom of the boot, i.e. lowers the trailing edge of the boot. Since the laser reference receiver is on a line above the front of the boot, this increased angle results in the trailing edge of the boot being significantly lower than the reference plane established by the laser and sensed by the laser receiver. Therefore, the depth of the ditch can be several inches deeper than desired. In the opposite case, where soil becomes hard to penetrate, the digging arm tends to rise up out of the ditch. The laser referenced grade control reacts by decreasing the up planing angle of the bottom of the boot. The laser mast supporting the laser receiver, which had been in a substantially vertical orientation, is now tilted forward so that the receiver is lowered toward the front of the digging arm and senses the digging arm below the reference plane even though the bottom of the boot is too high. In this case, the ditch will be shallower than desired.

The laser grade control systems have controlled the grade cylinders of such trenching machines for controlling the grade of the digging arm. It has been known that the lift cylinders of such trenching machines may be manually controlled for correcting the attitude of the digging arm when changes in soil consistency are encountered. However, no one has heretofore known how to automatically compensate for the changes in the altitude of the ditch being dug as a result of changes in soil consistency.

SUMMARY OF THE INVENTION

Attitude control systems of the present invention involve maintaining pitch of a trailing or connected member by an increase or decrease in pitch altitude in conjunction with pitch angle. In typical applications of the attitude control systems in accordance with the invention the path of the connected member is determined with respect to a horizontal reference by coordinating an increase and decrease of pitch altitude with pitch angle. The coordination and predetermination of botn pitch altitude and pitch angle determines the path of travel of the connected member.

Essentially if pitch angle is maintained at 90° the path of the connected element will track the path of the horizontal plane. However, where a pitch angle change from 90° from the horizontal reference occurs the path or depth of the connected element will not maintain the desired grade. In trenching operations the 90° pitch angle is subject to variation due to variations in soil consistency such as sand, clay and rock.

The control system of the present invention accomodates soil conditions and operation dependent factors effecting the grade stability characteristics of subsurface or surface drainage control. Sensor recognized and controlled inputs may be implemented manually or automatically to minimize or eliminate completely the adverse effects of soil conditions or operation dependent factors on the grade control stability of subsurface or surface drainage control installations. The effects of soil conditions or operation dependent factors are reflected primarily in the pitch angle with subsequent change in the pitch attitude of the digging mechanism.

The present system accomodates these changes by utilizing a slope sensor for detecting these changes in pitch angle. An amplifier for processing the signals from the slope sensor and sending a control signal where desired to an electro mechanical actuator, and an actuator for correcting an improper pitch angle or attitude of the digging mechanism.

Alternatively in some trenching applications it is desirable to control grade cylinders by pitch angle alone to obtain the desired pitch attitude. In the description of the invention it will be recognized by those skilled in the art that pitch angle or the angle of the connected member in conjunction with the horizontal pitch or altitude difference with respect to the horizontal reference determines the pitch attitude or grade.

Variations in pitch angle may be detected and measured by employing a slope sensor mounted on the digging implement of a trencher to sense the pitch angle of the connected member or digging implement with respect to a reference such as gravity or the angle resulting from the movement of the arms of the trencher. The output from the slope sensor is then connected to a motor control apparatus for controlling the lift motor or cylinders on the trenching machine to maintain the pitch attitude or grade in agreement with the reference plane as the digging implement encounters changes in soil consistency.

BRIEF DESCRIPTION OF THE DRAWING

These and other features and advantages will become apparent from a detailed description of the invention taken in conjunction with the drawings in which.

DETAILED DESCRIPTION OF THE INVENTION

Figures 1, 2:
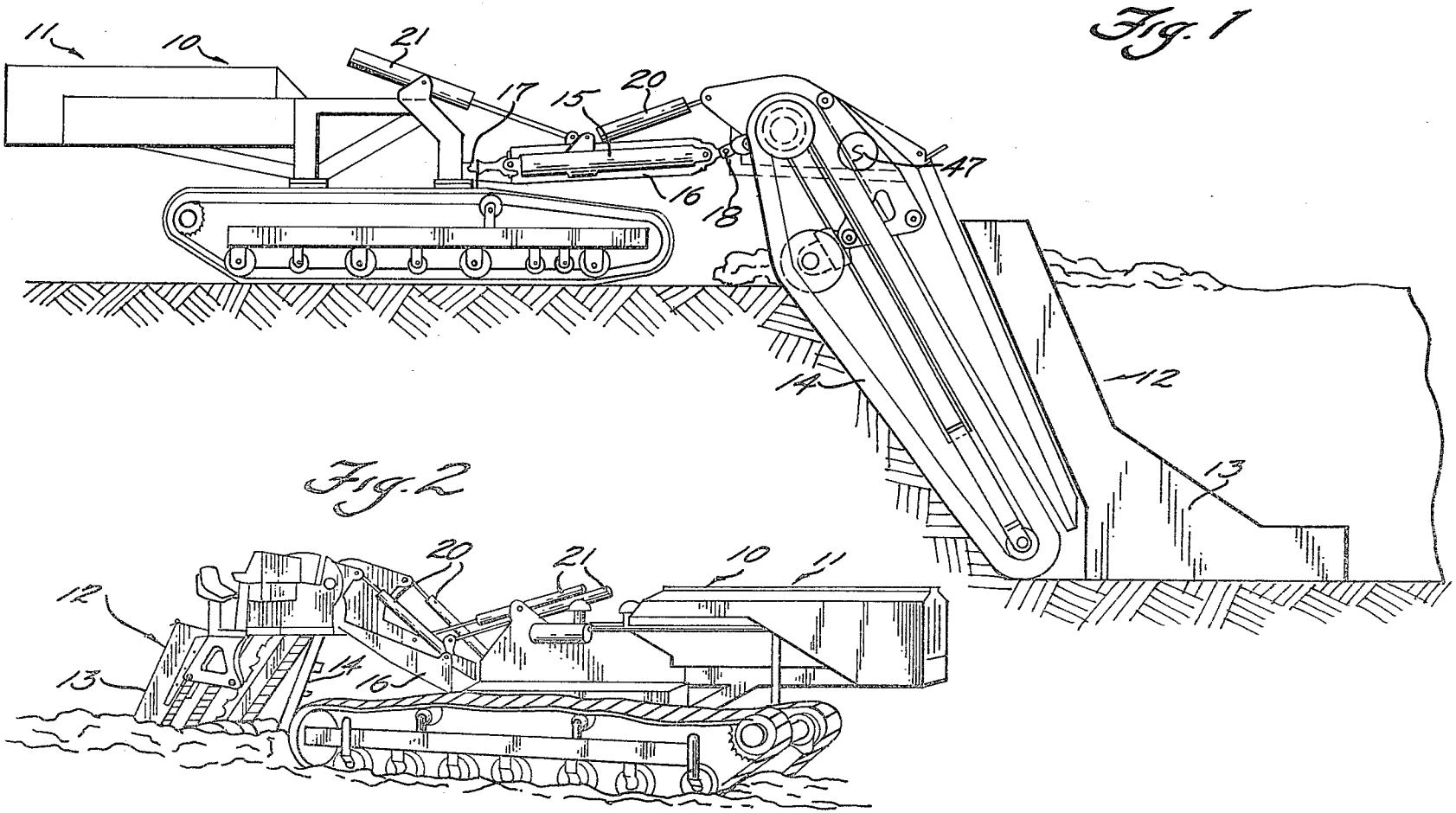
FIG. 1 is a side view of a typical trenching machine which can be controlled by the present invention.
FIG. 2 is a perspective view of the machine of FIG. 1.
Figure 3:
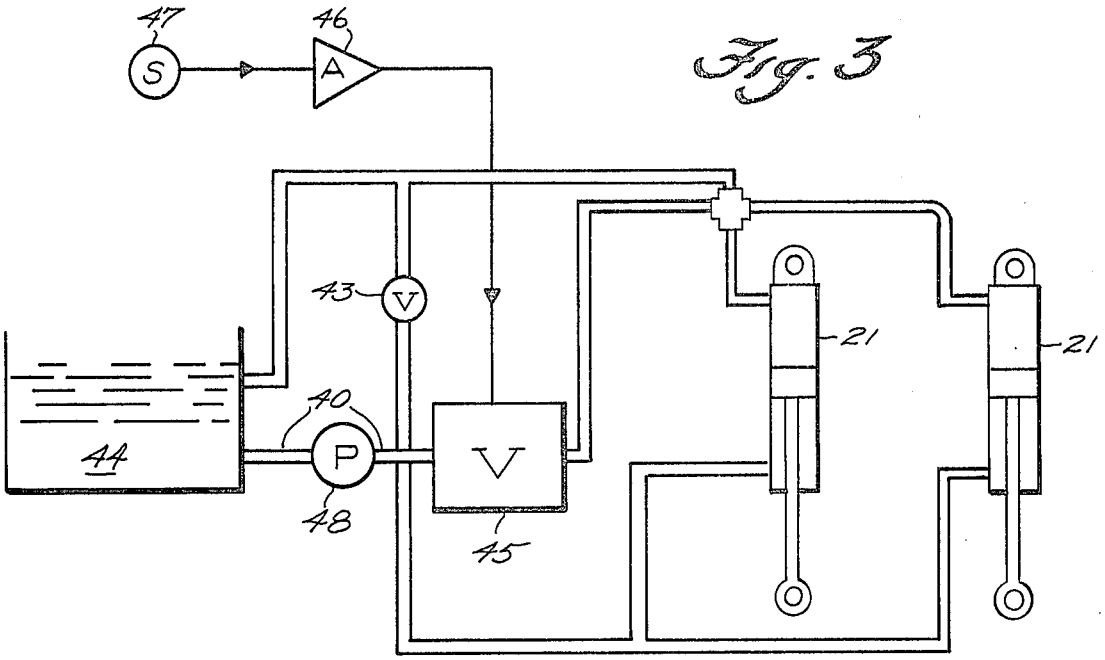
FIG. 3 is a schematic diagram of one form of the invention.
Figure 4:
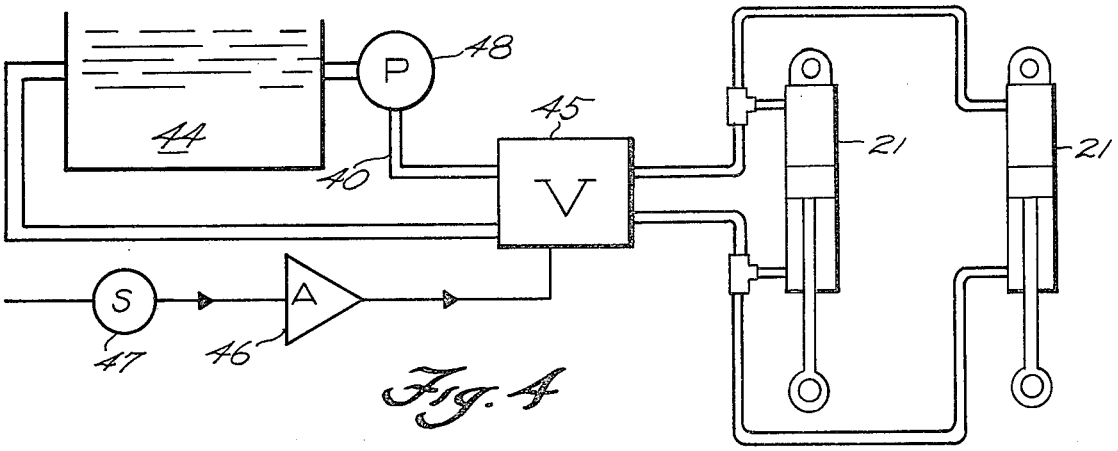
FIG. 4 is a schematic diagram of another form of the invention.

Referring now to FIGS. 1 and 2, trenching machine 10 has a tractor machine portion 11 and digging arm or implement portion 12. The digging implement portion has boot 13 for riding on the bottom of the ditch being dug and an endless type digging chain 14 which has a plurality of digging scoops mounted thereon for excavating the earth and forming the trench or ditch. The power drive for the endless chain type digging apparatus 14 is provided by drive 15 located in linkage 16. The linkage 16 is pivoted at one end at junction 17 between linkage 16 and tractor 11 and at its other end at junction 18 between linkage 16 and digging implement 12. Grade cylinders or motor means 20 are provided and may be controlled by the laser grade control system shown in FIG. 5 for moving digging implement 12 about junction 18 and lift cylinders or motor means 21 are provided which may be controlled by the slope sensor of the invention as shown in FIGS. 3 and 4 moving digging implement 12 and linkage 16 about junction 17. Although a particular type of digging implement 12 is shown, it will be realized that other types of digging implements such as digging wheels may also be controlled by the present invention.

Figure 5:
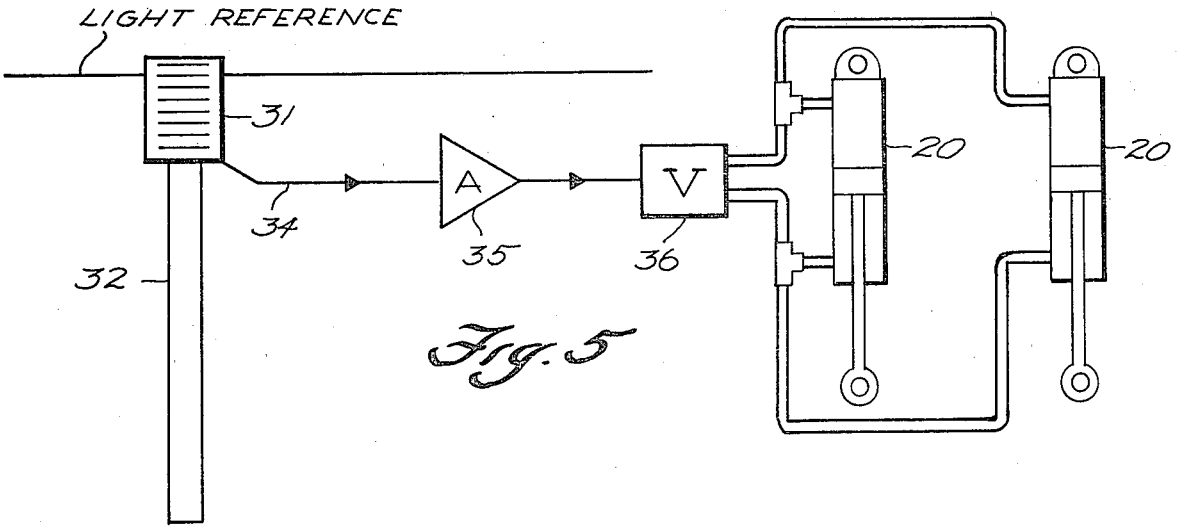
FIG. 5 is a schematic diagram of a typical laser control system which can be used to control the grade cylinders of the trenching machine of FIGS. 1 and 2.

As shown in FIG. 5, grade control system 30 comprises a laser receiver 31 mounted on pole 32 which can then be attached to digging implement 12 as suggested in U.S. Pat. Nos. 4,034,490 and 4,050,171 both of which disclose a laser grade control system for trenching machines. Laser receiver 31 receives a laser beam of light 33 established by a laser (not shown) and provides an output on line 34 to amplifier 35. The output of amplifier 35 is then connected to valve 36 which is used to control the flow of hydraulic fluid to grade cylinders 20 as shown in FIG. 5.

If the digging implement 12 should drop below the grade reference as established by laser beam 33 indicating that the digging implement 12 is digging too deep, an output is provided by receiver 31 through amplifier 35 and then to valve 36 for appropriate adjustment of cylinders 20. Cylinders 20 will then extend to close up an imaginary angle formed on the underside of linkage 16 and digging implement 12 in which junction 18 forms a pivot point. Thus, the attack angle of digging implement 12 is changed in a direction to allow boot 13 and digging arm 12 to plane up out of the ditch until laser receiver 31 senses the proper elevation as established by reference 33. In the alternative, if receiver 31 senses that the depth of the ditch is too shallow, it provides an appropriate output on line 34 to amplifier 35 and then to valve 36 for an appropriate adjustment of cylinders 20. Cylinders 20 will contract to open up the angle between linkage 16 and digging implement 12 allowing the digging implement 12 to bite deeper into the earth being excavated and thereby plane deeper until receiver 31 senses the proper depth for the ditch as established by laser beam reference 33.

Should digging implement 12 encounter changes in soil consistency, however, it is possible for the angle between linkage 16 and junction 17 to change and yet be substantially uncompensated by laser receiver 31. As mentioned previously, it has been found that the depth of the ditch can change from the desired depth as established by the laser beam reference 33. Changes in ditch depth due to changes in soil consistency can be corrected by maintaining digging implement 12 in a predetermined pitch angle.

In order to detect improper changes in pitch angle of digging implement 12, the system shown in FIG. 3 can be provided. This system will consist of a slope sensor or some means of detecting the angular rotation of digging implement 12 and linkage 16 about junction 17, an amplifier for detecting the input from the slope sensor and sending control signals to a restrictor valve, and a restrictor valve for varying system pressure in FIG. 3. By maintaining the digging implement 12 in a predetermined pitch angle, the effects of changes in soil consistency on the depth of the ditch being dug by trencher 10 will be minimized. In FIG. 3 an inlet hydraulic fluid line 40 is supplied with hydraulic fluid from a reservoir to a pump 48 which is driven by the engine of tractor 11 of trenching machine 10. The hydraulic fluid is supplied through restriction valves 43 and 45 and back to reservoir 44. Valve 43 is a manual valve which is optional and used to improve the operation of the system. Namely, valve 43 sets the maximum pressure when valve 45 closes completely. The cylinders 21 are connected in parallel with valves 43 and 45. Valve 45 is controlled by the output of amplifier 46 having its input connected to slope sensor 47 which, as can be seen in FIG. 1, is mounted on digging implement 12. Valve 45 is connected in parallel with valve 43 such that the combination of restriction valves 43 and 45 performs the function of a variable restriction connected to control the amount of pressure required to force a constant volume of hydraulic oil through the system in FIG. 3. This hydraulic back pressure as it is so called is reflected on one side of cylinders 21 via the connecting line between the pump 48 and restriction valve 45. By varying the amount of back pressure reflected on cylinders 21 the effect is that the amount of weight being placed on the ditch bottom by digging implement 12 is varied to compensate for varying ditch bottom or soil conditions. For example, if the digging implement 12 encounters a soft bottom, then the pressure on cylinders 21 would be increased to prevent a rotation of digging mechanism 12 and linkage 16 about junction 17.

It has been found that if the systems of FIG. 3 and FIG. 5 are connected to the same set of motors or hydraulic cylinders, the systems tend to fight each other and proper control is not realized. Therefore, the system of FIG. 5 is connected to one set of cylinders and the system of FIG. 3 is connected to the other set of cylinders. For purposes of definition, the cylinders to which the system of FIG. 5 is connected are referred to as the grade cylinders and the cylinders to which the system of FIG. 3 is connected are referred to as the lift cylinders.

When digging implement 12 encounters a change in soil consistency which causes a downward rotation of digging implement 12 and linkage 16 about junction 17 the slope sensor 47 will detect this change and the amplifier 46 will send a signal to valve 45 to increase the pressure exerted on one side of cylinders 21 to stop this rotation. When the digging implement 12 encounters a change in soil consistency which causes an upward rotation of digging implement 12 and linkage 16 about junction 17 the slope sensor 47 would sense this rotation and amplifier 46 would send a signal to valve 45 to reduce the amount of pressure on cylinder 21 and place more weight of digging implement 12 on the ditch bottom. It will be noted that cylinders 21 of FIG. 3 are not positively driven in both directions therefore when hydraulic pressure is removed from hydraulic cylinders 21, it is only the weight of the digging implement 12 which allows cylinders 21 to expand and the digging implement 12 to bear harder on the support area of the boot 13, the apparatus shown in FIG. 4 however is designed to provide action on digging implement 12 in both directions. In this embodiment valve 45 is connected in a standard four way configuration to cylinders 21 rather than as a restrictor. Valve 43 is not used in this case. The configuration in FIG. 4 may be desired over the configuration in FIG. 3 where positive control is necessary in both directions such as some plows, which are a trenchless method of drainage installation.

When control of the pitch angle only is desired as in applications requiring only a slope angle on the installation and no horizontal reference the slope sensor 47 may be substituted in place of the laser receiver 31 as shown in FIG. 5, and this system used to control grade cylinders 20. This type of system would be used where the installation simply needed a slope angle such as parking lot drainage, or tile installation in hilly areas where the vertical range of the laser is limited and its accuracy not necessary.

This system configuration shown in FIG. 5 with the slope sensor 47 substituted for the laser receiver 31, could be used for various applications requiring only pitch angle control such as dozer, grader, scraper or land levelers, or various other implements used in land excavation.

It will be recognized that the present invention has a wide range of applicability to a variety of earth moving machinery and vehicles employing a connected member pivotally associated with the machinery which requires maintenance of the connected member at a predetermined depth. The present invention may be modified by utilizing other horizontal reference means other than lasers. These and other modifications and other applications of the present invention may be made within the spirit and scope of the invention as defined in the appended claims.

What is claimed is:

1. An attitude control system for controlling the grade of a pitch angle and pitch altitude grade responsive connected member in relation to a reference comprising:
   (a) means for sensing the pitch angle component of a connected member having grade determined by a combination of pitch angle and pitch altitude components;
   (b) means for maintaining the pitch altitude component of said connected member with respect to a reference;
   (c) motor control means for adjusting pitch angle to maintain said connected member at a predetermined grade; and,
   (d) means for coordinating changes in the sensed pitch angle component with the motor control means to maintain the amount of pitch angle correction necessary to maintain a pre-determined grade.

2. The pitch attitude control system of claim 1 further comprising means for sensing the pitch altitude component of said connected member with respect to a reference and wherein said means for coordinating further coordinates said sensed pitch altitude with said pitch angle and said motor control means.

3. The attitude control system of claim 2 wherein said means for sensing pitch angle additionally comprises an amplifier.

4. The attitude control system of claim 2 wherein said means for sensing the pitch altitude component additionally comprises an amplifier.

5. The attitude control system of claim 4 wherein said motor control means comprises a hydraulic circuit having a valve adapted to control the pressure of hydraulic fluid from a source of hydraulic fluid to said motor means, said valve having an electrical input adapted to receive a signal from said amplifier.

6. The attitude control system of claim 2 wherein said motor control means comprises a hydraulic circuit having a valve adapted to control the pressure of hydraulic fluid from a source of hydraulic fluid to said motor means, said valve having an electrical input adapted to receive a signal from said pitch angle sensing means.

7. A pitch attitude control system for controlling pitch attitude of an earth moving implement responsive to pitch angle and pitch altitude components wherein said earth moving implement is pivotally attached to an earth moving machine comprising:
   (a) means for sensing the pitch angle component of an earth moving implement attached to an earth mover wherein pitch attitude is determined by a combination of pitch angle and pitch altitude components;

(b) a first actuator connected between said earth mover and said earth moving implement for adjusting pitch angle;

(c) means for sensing the pitch altitude component of said earth moving implement with respect to a horizontal reference;

(d) a second actuator said second actuator connected between said earth mover and said earth moving implement for adjusting the amount of displacement with respect to a horizontal reference; and (e) motor control means for actuating said first actuator and said second actuator.

8. The pitch attitude control system of claim 7 additionally comprising means connecting said pitch angle sensing means to said motor control means whereby changes in pitch attitude of said digging implement are sensed by said pitch angle sensing means and said motor control means responds to said pitch angle sending means by maintaining said digging implement at a predetermined pitch attitude.

9. The pitch control system of claim 7 wherein said motor control means comprises a hydraulic circuit having a valve for controlling the flow of hydraulic fluid from a source of hydraulic fluid to said second actuator means, said valve having an electrical input adapted to receive a signal from said pitch angle sensing means.

10. The pitch attitude control system of claim 8 wherein said connecting means comprises an amplifier.

11. The pitch attitude control system of claim 10 wherein said motor control means comprises a hydraulic circuit having a valve for controlling the flow of hydraulic fluid from a source of hydraulic fluid to said second actuator means, said valve having an electrical input to receive a signal from said pitch angle amplifier.

12. The pitch attitude control system of claim 10 wherein said motor control means comprises a hydraulic circuit having a valve for controlling the pressure of hydraulic fluid from a source of hydraulic fluid to said second actuator means, said valve having an electrical input to receive a signal from said pitch angle amplifier.

13. A pitch attitude control system for controlling the pitch attitude of the digging implement of an earth-trenching machine, the digging implement being pivotally attached to said machine by a pivotal linkage, said machine having a first actuator means connected between said pivotal linkage and said digging implement and second actuator means connected between said machine and said pivotal linkage, one of said first and second actuator means being responsive to a grade control system for controlling the digging implement at a predetermined grade depth in response to a grade reference, said pitch attitude control system comprising:

slope angle sensing means adapted to be mounted on said digging implement for sensing the pitch angle of said digging implement;

motor control means adapted to be connected to said first and second actuator control means; and, connecting means connecting said slope angle sensing means to said motor control means whereby changes in pitch angle of said digging implement are sensed by said slope angle sensing means and said other of said first actuator and second actuator responds to said slope angle sensing means for maintaining said digging implement at a predetermined pitch attitude.

14. The pitch angle control system of claim 13 wherein said motor control means comprises a hydraulic circuit having a valve adapted to control the flow of hydraulic fluid from a source of hydrualic fluid to said second motor means, said valve having an electrical input adapted to receive a signal from said slope angle sensing means.

15. The pitch angle control system of claim 14 wherein said motor control means is adapted to be connected to said second actuator and said first motor means responds to said grade control system.

16. The pitch angle control system of claim 13 wherein said connecting means comprises an amplifier.

17. The pitch angle control system of claim 16 wherein said motor control means comprises a hydraulic circuit having a valve adapted to control the flow of hydraulic fluid from a source of hydraulic fluid to said second actuator, said valve having an electrical input adapted to receive a signal from said amplifier.

18. The pitch angle control system of claim 17 wherein said motor control means is adapted to be connected to said second actuator and said first actuator responds to said grade control system.

19. The pitch angle control system of claim 13 wherein said motor control means is adapted to be connected to said second actuator means and said first actuator responds to said grade control system.

20. A pitch angle control system for controlling the pitch angle of the digging implement of an earth trenching machine, the digging implement being pivotally attached to said machine by a pivoted linkage, said machine having first motor means connected between said pivotal linkage and said digging implement and second motor means connected between said machine and said pivotal linkage, one of said first and second motor means being responsive to a grade control system for controlling the digging implement at a predetermined grade depth in response to a grade reference, said pitch angle control system comprising:

slope sensing means mounted on said digging implement for sensing the pitch attitude of said digging implement;

motor control means connected to the other of said first and second motor control means; and, connecting means connecting said slope sensing means to said motor control means whereby changes in pitch angle of said digging implement are sensed by said slope sensing means and said other of said first and second motor control means responds to said slope sensing means for maintaining said digging implement at a predetermined pitch attitude.

21. The pitch angle control system of claim 20 wherein said motor control means comprises a hydraulic circuit having a valve for controlling the flow of hydraulic fluid from a source of hydraulic fluid to said second motor means, said valve having an electrical input adapted to receive a signal from said slope sensing means.

22. The pitch angle control system of claim 21 wherein said motor control means is adapted to be connected to said second motor means and said first motor means responds to said grade control system.

23. The pitch angle control system of claim 20 wherein said connecting means comprises an amplifier.

24. The pitch angle control system of claim 23 wherein said motor control means comprises a hydraulic circuit having a valve for controlling the flow of hydraulic fluid from a source of hydraulic fluid to said second motor means, said valve having an electrical input to receive a signal from said amplifier.

25. The pitch angle control system of claim 24 wherein said motor control means is connected to said second motor means and said first means responds to said grade control system.

26. The pitch angle control system of claim 20 wherein said motor control means is connected to said second motor means and said first motor means responds to said grade control system.

27. A pitch attitude control system for controlling the pitch attitude of an earth moving implement having pitch attitude resulting from a combination of pitch angle and pitch altitude components wherein said earth moving implement is pivotally attached to an earth mover machine comprising:

(a) means for sensing the pitch angle component of an earth moving implement pivotally connected to an earth moving machine having pitch attitude determined by a combination of pitch angle and pitch altitude components;

(b) means for sensing the pitch altitude component of said implement with respect to a horizontal reference;

(c) means for coordinating the pitch angle component with the pitch altitude component and determining the necessary component correction to maintain a predetermined grade with respect to a horizontal reference; and (d) motor control means for adjusting pitch angle and pitch altitude to maintain said earth moving implement at a predetermined grade with respect to said reference.

28. The pitch altitude control system of claim 27 wherein said means for sensing the pitch angle component with respect to a reference is a slope sensor and said motor control means includes a first actuator and a second actuator wherein said first actuator is connected between the earth mover and said earth moving implement for adjusting pitch angle and said second actuator is connected between the earth mover and said earth moving implement for adjusting the amount of displacement with respect to the horizontal reference.

29. The pitch attitude control system of claim 28 wherein said means for sensing the pitch altitude component is a laser receiver.

30. The pitch altitude control system of claim 29 wherein said means for coordinating said pitch angle component with said pitch altitude component and determines the necessary component correction to maintain a predetermined grade, computes pitch angle changes and actuates said first actuator to maintain a predetermined attitude with respect to said horizontal reference.

31. The pitch attitude control system of claim 27 wherein said means for sensing said pitch angle component additionally comprises an amplifier and said means for sensing said pitch altitude component additionally comprises an amplifier.

32. The pitch attitude control system of claim 31 wherein said means for coordinating the pitch angle component with said pitch altitude component to determine the necessary component correction to maintain a predetermined grade to make said correction by adjusting said pitch angle component.

* * * * *

UNITED STATES PATENT AND TRADEMARK OFFICE

CERTIFICATE OF CORRECTION

PATENT NO. : 4,255,883
DATED : March 17,1981
INVENTOR(S) : David A. Ealy

It is certified that error appears in the above—identified patent and that said Letters Patent is hereby corrected as shown below:

Column 2, Line 4 second occurance the word "a" should be the word --the--;

In Fig. 3 fluid line 40 between 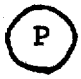 and 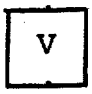 which appears as, " 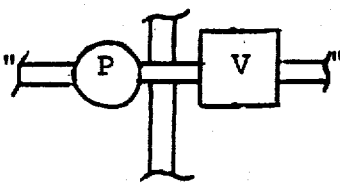 " should be -- 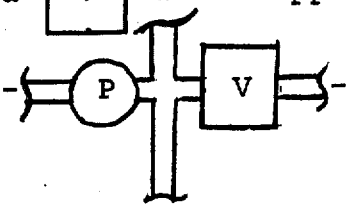 --.

Signed and Sealed this

Eighth Day of September 1981

[SEAL]

Attest:

GERALD J. MOSSINGHOFF

Attesting Officer

Commissioner of Patents and Trademarks